US005562129A

United States Patent [19]

Graffin

[11] Patent Number: 5,562,129

[45] Date of Patent: Oct. 8, 1996

[54] FILLING DEVICE INCLUDING A CLEANING MANIFOLD SECURED TO A DISPENSER DUCT

[75] Inventor: André Graffin, La Chapelle Du Bois, France

[73] Assignee: Serac, Laferte-Bernard, France

[21] Appl. No.: 455,395

[22] Filed: May 31, 1995

[30] Foreign Application Priority Data

Jun. 2, 1994 [FR] France ..... 94 06753

[51] Int. Cl.[6] ..... B65B 1/04; B65B 3/04; B67C 3/02

[52] U.S. Cl. ..... 141/90; 141/89; 141/91; 141/147; 222/148; 239/112

[58] Field of Search ..... 141/86, 87, 88, 141/89, 90, 91, 383, 384, 370, 372, 374, 311 A, 147; 222/148, 149, 153; 239/106, 110, 112

[56] References Cited

FOREIGN PATENT DOCUMENTS

| | | |
|---|---|---|
| 0568121 | 2/1993 | European Pat. Off. . |
| 1389884 | 3/1964 | France . |
| 2540754 | 2/1983 | France . |
| 2593490 | 1/1986 | France . |

*Primary Examiner*—Henry J. Recla
*Assistant Examiner*—Timothy L. Maust
*Attorney, Agent, or Firm*—Griffin, Butler, Whisenhunt & Kurtossy

[57] ABSTRACT

The manifold is secured to the dispenser duct adjacent an outflow nozzle and comprises an outlet orifice arranged directly above the outflow nozzle and is associated with a removable closure member secured to a lower end of a support member and associated with a control member which ensures that the closure member is applied against the outlet orifice of the manifold by a toggle action of the support member.

10 Claims, 3 Drawing Sheets

FILLING DEVICE INCLUDING A CLEANING MANIFOLD SECURED TO A DISPENSER DUCT

The present invention relates to a filling device including an integral cleaning device.

BACKGROUND OF THE INVENTION

A known filling device, for example the filling carousel disclosed in document FR-A-2540754, comprises a series of filling heads fitted with an integral cleaning device. The cleaning device comprises a manifold secured to the dispenser ducts of the filling heads adjacent the outflow nozzles of the dispenser ducts so as to form a sealed assembly with those ducts, the manifold including an outlet orifice arranged directly below the outflow nozzle of each filling head, each outlet orifice being associated with a removable closure member. In document FR-A-2540754, the closure member is a stopper which is secured in each outlet orifice before cleaning so as to close each outlet orifice during cleaning. In a rotary filling carousel, an operator generally has access to the outlet orifices only in a limited region of the carousel, and in order to ensure that all stoppers are correctly placed, it is therefore necessary to rotate the carousel so as to bring the outlet orifices successively into the access zone.

For obvious safety reasons, it is not possible for the operator to insert the closure members whilst the carousel is rotating, even at slow speed. It is therefore necessary to cause the carousel to perform a series of starts and stops so as to bring all the outlet orifices successively within reach of the operator. Such an operation is time-consuming and tedious and substantially increases the time required for cleaning the filling device. Moreover, there is a danger that the operator could drop a closure member so that it falls into a relatively inaccessible part of the filling device. Finally, when the cleaning operation has been completed, the manual intervention of an operator removing the stoppers could give rise to contamination incompatible with utilization of the filling device in hygienic conditions.

OBJECTS AND SUMMARY OF THE INVENTION

An object of the present invention is to propose a filling device including an integral cleaning device which allows easy handling of the closure members, or even, in a preferred embodiment, completely automatic actuation of the closure members.

With a view to achieving this object, the invention provides a filling device including at least one dispenser duct fitted with a cleaning device which comprises a manifold secured to the dispenser duct adjacent an outflow nozzle so as to form a sealed assembly with the duct, the manifold comprising an outlet orifice arranged directly below the outflow nozzle and associated with a removable closure member, wherein the closure member is secured to a lower end of a support member, the upper end of which is hinged to the sealed assembly at a level above the outlet orifice of the manifold, the support member being associated with a control member which ensures that the closure member is applied against the outlet orifice of the manifold by a buttressing toggle action of the support member.

Thus, the closure member is placed in position or withdrawn by actuation of the control member without it being necessary for the operator to have access to the outlet orifice of the manifold.

In an advantageous version of the invention, the support member comprises at least one wing pierced with an oblong slot engaged over a hinge pin carried by the filling head, and an operating member spaced from the oblong slot in a longitudinal direction of the slot, and the control member comprises at least one lever mounted on the hinge pin, the lever comprising an eccentric portion having the operating member of the support member kept thereagainst. Thus, successive pivoting and translational movement of the support member can be achieved using a single control member.

In a preferred embodiment of this aspect of the invention, the control member includes retaining notches. These retaining notches keep the support member and the control member in defined relative positions which correspond to the principal stages in the operation of the support member.

In a further advantageous aspect of the invention, the device includes a resilient member arranged so as to keep the operating member for the support member against the eccentric portion of the control member. Thus, the operating member for the support member bears constantly against the eccentric portion of the control member, even when the device is subjected to vibration.

In a still further advantageous aspect of the invention, the device includes an actuating member, preferably comprising retractable cams. It is therefore possible to operate the closure member without any manual intervention.

BRIEF DESCRIPTION OF THE DRAWINGS

Other features and advantages of the invention become apparent on reading the following description of a particular non-limiting embodiment of the invention, given with reference to the accompanying drawings in which.

MORE DETAILED DESCRIPTION

Figure 1:
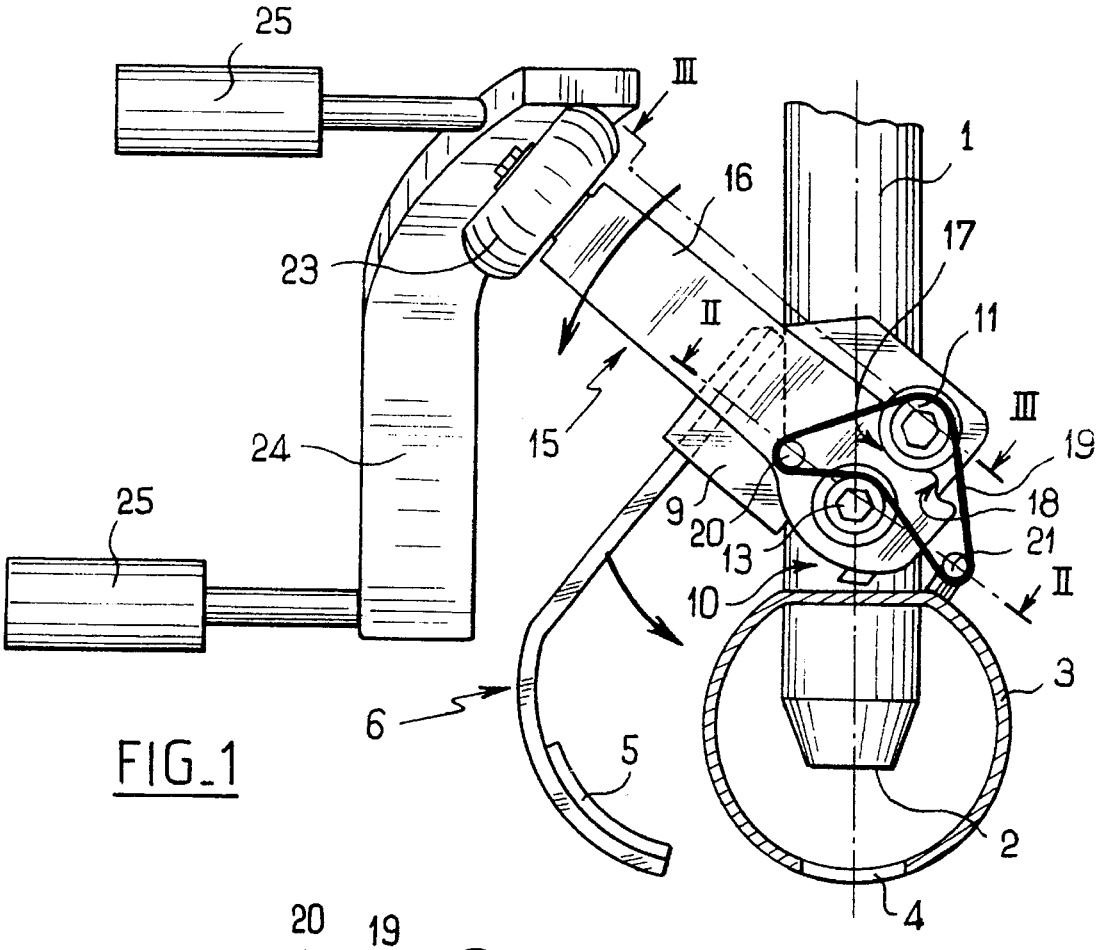
FIG. 1 is an elevation view of a filling device of the invention, the removable closure device being illustrated in a retracted position relative to the outlet orifice.
Figure 2:
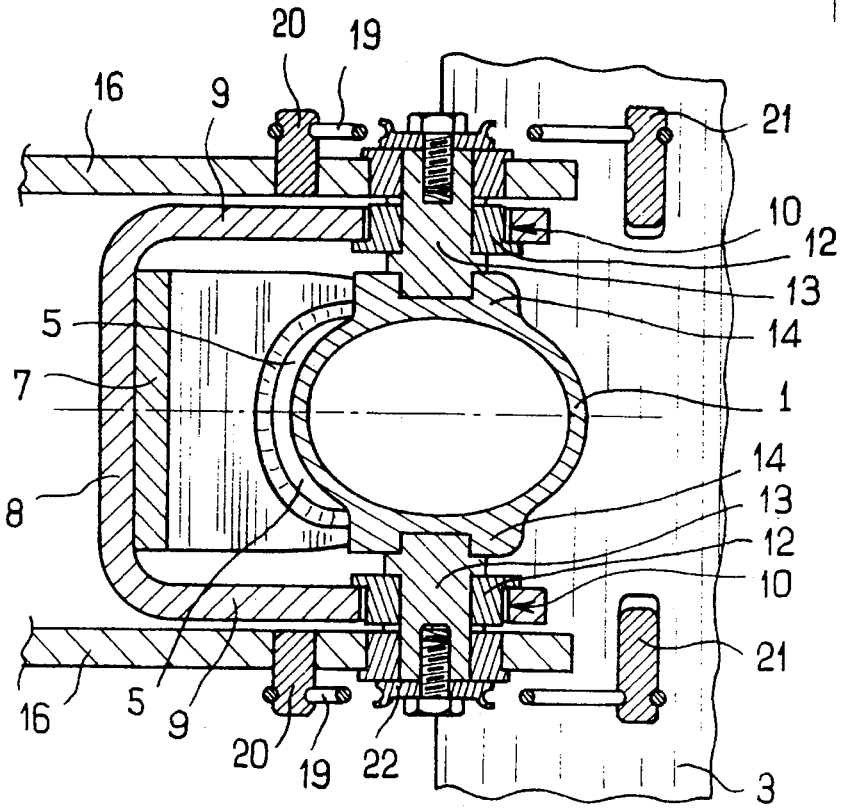
FIG. 2 is an enlarged section view along the line II—II of FIG. 1.
Figure 3:
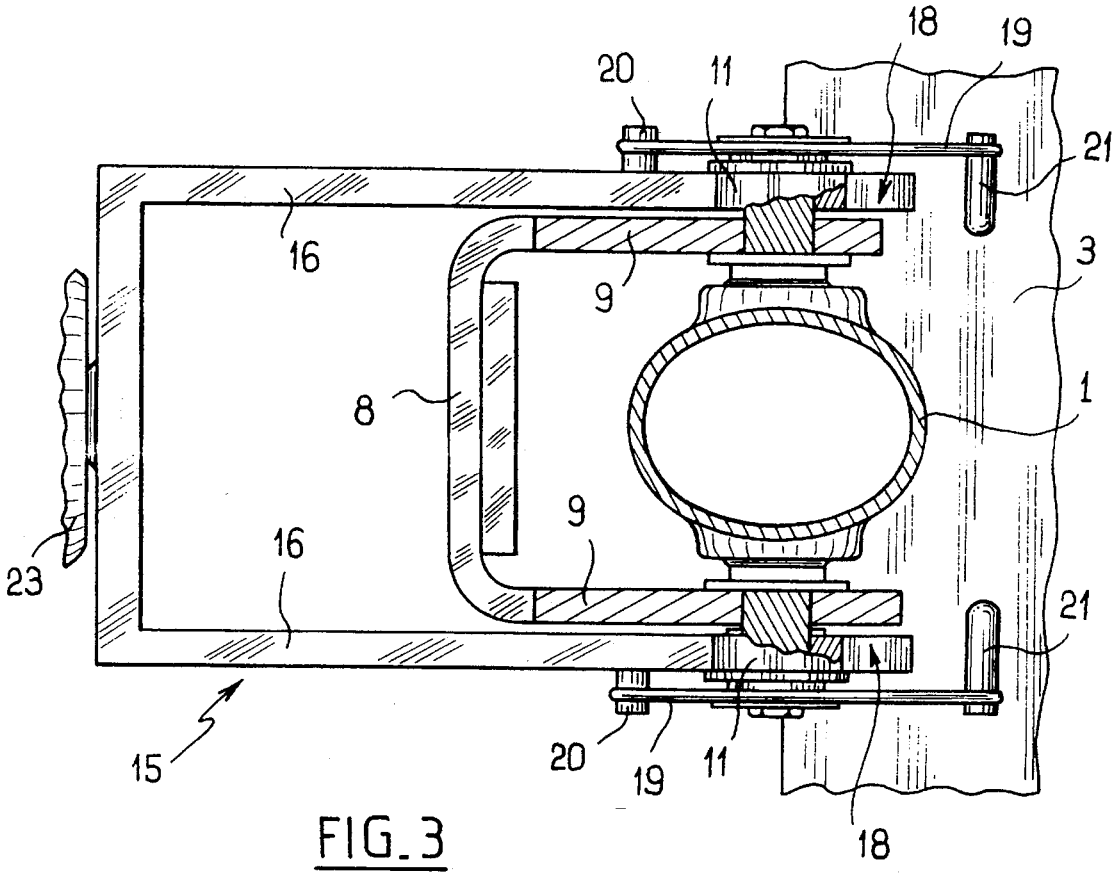
FIG. 3 is an enlarged section view along the line III—III of FIG. 1.
Figure 4:
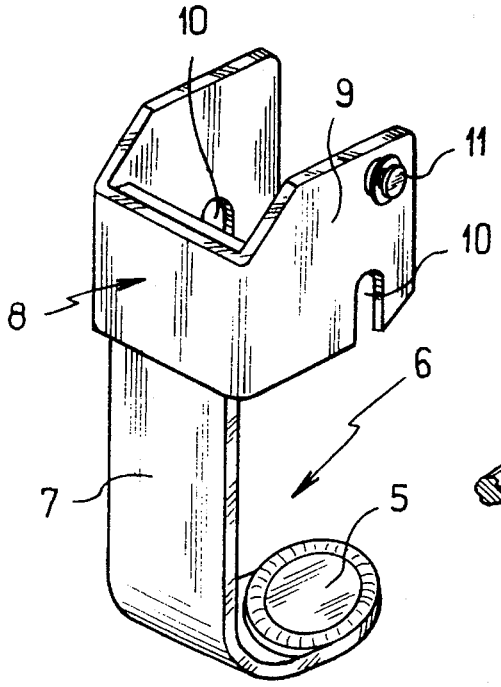
FIG. 4 is a perspective view of the support member.

With reference to the figures, the filling device of the invention comprises a series of filling heads, only one of which is shown in the figures.

In the embodiment shown, the filling heads are mounted as a rotary carousel, i.e. the filling heads are arranged in a circle and when the device is in operation, they rotate about a central axis. In known manner, each filling head comprises a supply duct suitably connected to a supply member (not shown), and emerging into a dispenser duct 1 comprising an outflow nozzle 2 at its bottom end.

Also in known manner, the filling heads are associated with an integral cleaning device comprising a toroidal manifold 3 secured to the dispenser ducts adjacent the outflow nozzles 2, for example by welding, to form a sealed assembly. The bottom ends of the dispenser ducts 1 are engaged inside the manifold 3 which includes an outlet orifice 4 arranged directly below the outflow nozzle 2 of each filling head. A removable closure member 5 is associated with each outlet orifice 4.

In accordance with the invention, the closure member 5 is carried by a support member given general reference 6.

in the preferred embodiment illustrated, the support member 6 comprises an upwardly-curved support plate 7, the upper end of which is secured to a yoke 8 having wings 9 pierced with oblong slots 10 which open out in the lower edges of the wings 9. Operating members (e.g. rollers) 11 are secured to the wings 9 at points lying on the long axis of each slot 10. During assembly of the device, the oblong slots 10 are engaged over rollers 12 mounted on hinge pins 13 carried on bosses 14 on the dispenser duct 1. By virtue of the oblong shape of the slots 10, the support member 6 may either pivot about the hinge pins 13, or else it may slide relative to the pins in the long direction of the oblong slots 10.

The device further includes a control member 15 formed as a yoke comprising wings 16 which are also mounted to pivot about the hinge pins 13 outside the yoke 8. The upper edge of the each wing 16 comprises two retaining notches 17, 18 both of which are eccentric relative to the hinge pins 13, the bottoms of the notches 17 being closer to the hinge pins 13 than the bottoms of the notches 18. The top edges of the wings 16 are of curvilinear profile between the notches 17 and 18.

The depth of the oblong slots 10 and the distance of the operating members 11 from these slots are determined so that the operating members 11 can rest on the bottoms of the notches 17 when the yoke 8 is placed in position over the hinge pins.

The device also includes resilient members formed by elastic bands 19. Each elastic band 19 is mounted on a coupling member 20 secured to one wing 16 of the control member 15, and on a coupling member 21 secured to the manifold 3 on the side of the hinge pin 13 which is opposite to the coupling member 20. The elastic bands also pass over an external side of the operating members 11, and over an internal side of a guide 22 integral with the hinge pin 13, so that each elastic band 19 is constrained to follow a sinuous path between the coupling member 20 and the coupling member 21. The various functions provided by the elastic bands 19 become apparent below from the description of the operation of the device of the invention. On its connecting side, the control member 15 comprises an actuating roller 23 which faces an actuating cam 24 carried on the rods of two actuators 25 which either allow the cam 24 to be placed on the path of the actuating roller 23 or alternatively allow the actuating cam to be retracted away from the path of the actuating rollers 23. In the figures, the actuating cam shown is a closing cam.

Figure 5:
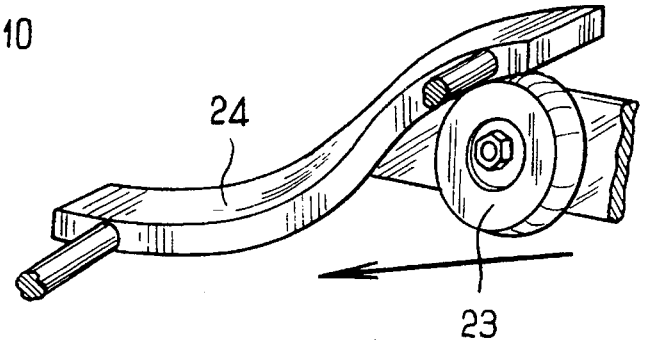
FIG. 5 is a perspective view of an actuating cam and of a portion of the control member associated with it.
Figure 6:
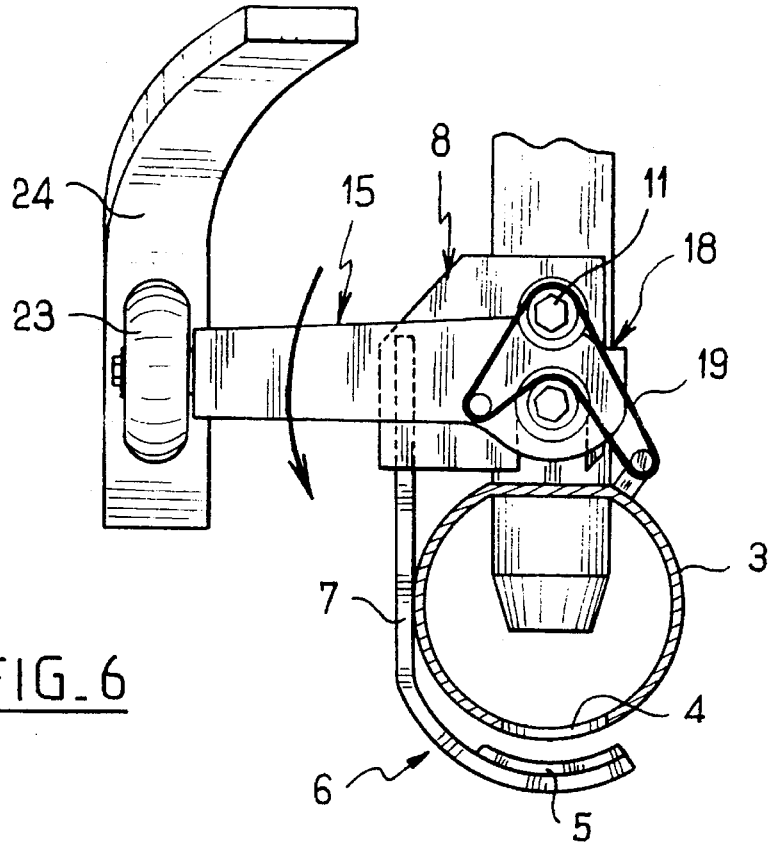
FIG. 6 is an elevation view similar to FIG. 1, in an intermediate stage in the closing of the outlet orifice.

The operation of the device of the invention is described in conjunction with FIGS. 1, 5, 6 and 7. In the position shown in FIG. 1, i.e. when the actuating roller 23 is not facing an actuating cam or is facing the initial contact portion of the actuating cam as shown in FIG. 5, the corresponding control member 15 is subjected to the traction force exerted by the elastic bands 19. As illustrated in the figures, this traction as applied to the coupling members 20 tends to cause the control member 15 to turn in a clockwise direction and to apply the operating members 11 against the upper edges of the wings 16 of the control member 15. In this position, the operating members 11 bear against the bottoms of the retaining notches 17 and the upper edge of the support plate 7 of the support member 6 bears against the side of the dispenser duct 1 so that the assembly is in a stable position in which the closure member 5 is spaced apart from the outlet orifice 4. When the actuating roller 23 contacts the descending portion of the closing cam 24, the actuating roller 23 causes the control member 15 to pivot in an anti-clockwise direction against the restoring action of the elastic bands 19. As a result of the operating members 11 bearing against the bottoms of the retaining notches 17, the yoke 8 follows the movement of the control member 15 up to an intermediate position as shown in FIG. 6 in which the support plate 7 bears against the side of the manifold 3, the closure member then being directly below and slightly spaced apart from the outlet opening 4.

Figure 7:
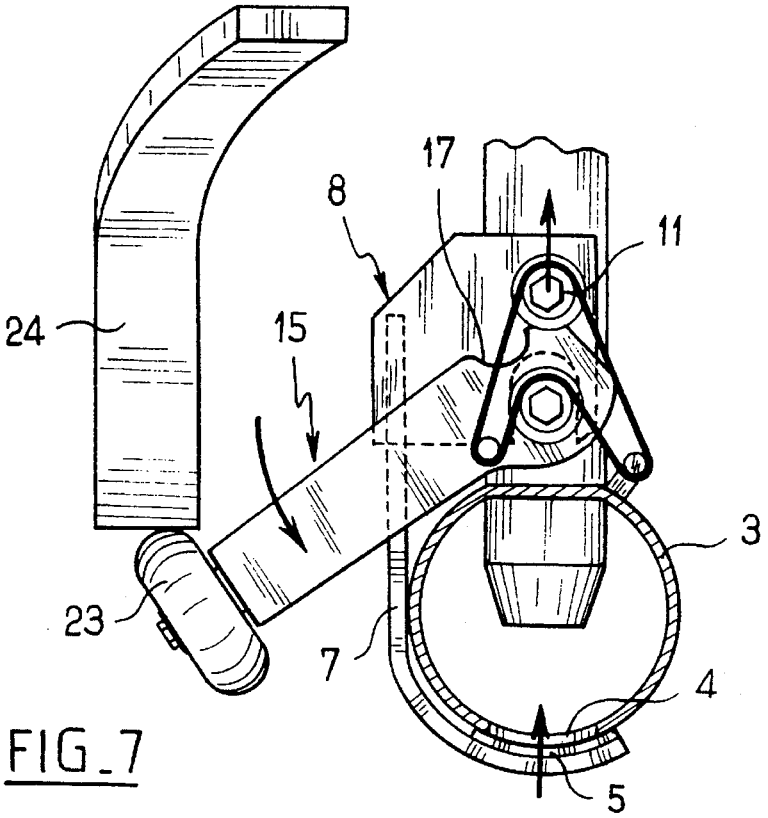
FIG. 7 is an elevation view similar to FIG. 1 for a closed position of the outlet orifice.

The continuing movement of the actuating roller 23 over the closing cam 24 causes additional pivoting of the control member 15 but since the support plate 7 is in abutment against the manifold 3, the yoke 8 cannot pivot any further, and the additional pivoting of the control member 15 therefore causes the operating rollers 11 to leave the retaining notches 17 and move towards the retaining notches 18. Since the retaining notches 18 are at a greater distance from the hinge pins 13 than the retaining notches 17, the operating rollers 11 are pushed upwardly as illustrated in FIG. 7 and move the yoke 8 and the associated closure member 5 vertically upwards. The closure member 5 is therefore pulled against the outlet orifice 4 and closes the manifold. It will be noted that during this movement, the sinuous profile of the elastic bands 19 is lengthened so that very strong traction is applied to the operating members 11. Since the operating members 11 are disposed in the long direction of the oblong slots 10, and the retaining notches 18 are orientated in a substantially perpendicular direction, the resulting force passes through the hinge pins 13 so that the device remains stably in this position in which the manifold is closed, even after the actuating member 23 of the control member has lost contact with the closing cam 24. It is therefore possible to proceed with cleaning the installation without stopping the device. After the installation has been cleaned, the closure members 5 are disengaged again from the outlet orifices 4 by placing an opening cam on the path of the actuation members 23, this cam having a profile opposite to that of the closing cam described above, the opening steps taking place in the opposite order to the closing steps.

The invention is of course not limited to the embodiment described and variants on the embodiment can be applied to the invention without departing from the scope of the invention as defined by the claims.

In particular, even though the device of the invention has been described in relation to a filling device comprising a rotary carousel, the device of the invention may be used in an installation in which the filling spouts are fixed. In this case, the actuating cams acting on the actuating roller 23 would be replaced by another actuating member, for example a actuator acting on the control member 15 so as to lower or raise that member. The mechanism may equally well be manually controlled.

Moreover, although in the embodiment illustrated the support member and the control member are implemented as yokes mounted on hinge pins arranged in the plane of symmetry of the dispenser duct, a single hinge pin may be arranged on one side of the dispenser duct 1 and the shapes of the support member and the control member may be adapted in corresponding manner so as to keep the closure member 5 in position by an over-center snap or toggle action of the support member during closing.

Although the invention has been shown with elastic bands which ensure both that there is a resilient restoring movement of the control member and of the support member towards a position spaced apart from the outlet orifice 4, and also that the operating members 11 bear against the control member 15, a device can be designed which includes separate restoring members for performing those two functions.

Although the invention has been described in relation to a filling head in which the dispenser duct emerges inside the manifold 3, the invention can be implemented in conjunction with a filling head having a structure similar to that described in document FR-A-2540754, i.e. one in which the outflow nozzle is formed in a retractable sleeve extending into the outlet orifice 4. Moreover, the closure member may have a structure similar to that of the stopper described in that document.

Although oblong slots 10 which open out in the lower edges of the wings 9 of the yoke 8 allow easy removal of the support member 6, the invention may nonetheless be implemented by providing oblong slots which do not open out in the edges of the wings.

I claim:

1. A filling device including at least one dispenser duct fitted with a cleaning device which comprises a manifold secured to the dispenser duct and adjacent an outflow nozzle so as to form a sealed assembly with the duct, the manifold comprising an outlet orifice arranged directly below the outflow nozzle and associated with a removable closure member, wherein an closure member is secured to a lower end of a support member, the upper end of the support member being hinged to the sealed assembly at a level above the outlet orifice of the manifold, the support member being associated with a control member which causes the closure member to be applied against the outlet orifice of the manifold by a toggle action of the support member.

2. A device according to claim 1, wherein the support member comprises at least one wing pierced with an oblong slot engaged over a hinge pin carried by the dispenser duct, and an operating member spaced from the oblong slot in a longitudinal direction of the slot, and wherein the control member comprises at least one lever mounted on the hinge pin, the control lever comprising an eccentric portion having the operating member of the support member kept thereagainst.

3. A device according to claim 2, wherein the oblong slot opens at a lower edge of the wing.

4. A device according to claim 2, wherein the eccentric portion of the control member comprises retaining notches.

5. A device according to claim 2, including a resilient member arranged so as to keep the operating member for the support member against the eccentric portion of the control member.

6. A device according to claim 5, wherein the resilient member is an elastic band engaged over the operating member and over a coupling member secured to the control member.

7. A device according to claim 6, wherein the elastic band is also engaged over a coupling member secured to the manifold on a side of the dispenser duct opposite to the coupling member which is secured to the control member.

8. A device according to claim 7, wherein the coupling member on the control member and the coupling member on the manifold are arranged on either side of the hinge pin carried on the dispenser duct, and wherein the elastic band bears against the hinge pin on a side of that pin which forces the elastic band to follow a sinuous path.

9. A device according to claim 1, including an actuating member for the control member.

10. A device according to claim 9, wherein the actuating member comprises retractable cams arranged opposite the control member.

* * * * *